US005996366A

United States Patent [19]

Renard

[11] Patent Number: 5,996,366

[45] Date of Patent: Dec. 7, 1999

[54] REFRIGERATED CABINET FOR DISPLAYING FOOD OR THE LIKE

[76] Inventor: André Renard, Résidence les Noisetiers, 131 chemin de Rigoumel, 83200 Toulon, France

[21] Appl. No.: 08/981,595

[22] PCT Filed: Jul. 5, 1996

[86] PCT No.: PCT/FR96/01055

§ 371 Date: Dec. 31, 1997

§ 102(e) Date: Dec. 31, 1997

[87] PCT Pub. No.: WO97/01977

PCT Pub. Date: Jan. 23, 1997

[30] Foreign Application Priority Data

Jul. 5, 1995 [FR] France ..... 95 08397

[51] Int. Cl.[6] ..... A47F 3/04

[52] U.S. Cl. ..... 62/256; 62/298

[58] Field of Search ..... 62/255, 256, 298

[56] References Cited

U.S. PATENT DOCUMENTS

| | | | |
|---|---|---|---|
| 2,915,884 | 12/1959 | Haushalter et al. | 62/256 |
| 4,845,957 | 7/1989 | Richardson | 62/255 |
| 4,898,004 | 2/1990 | Richardson | 62/255 |
| 5,168,817 | 12/1992 | Nulle et al. | 108/51.1 |
| 5,417,079 | 5/1995 | Rudick et al. | 62/255 |

FOREIGN PATENT DOCUMENTS

| | | |
|---|---|---|
| 1280016 | 5/1962 | France . |
| 2348450 | 11/1977 | France . |
| 2382861 | 10/1978 | France . |
| 2559882 | 8/1985 | France . |
| 3600174 | 7/1987 | Germany . |
| 9417698 | 8/1994 | WIPO . |

*Primary Examiner*—William E. Tapolcai
*Attorney, Agent, or Firm*—Ladas & Parry

[57] ABSTRACT

The present invention relates to a refrigerated cabinet for displaying and/or conserving food products or the like, e.g. in a shop. A product display module (3) suitable for being mounted in easily removable manner on an air cooler module (2) includes cool air flow means, and at its bottom portion includes a pallet (4) having air guide means (53). The technical field of the invention is that of making refrigerated cabinets.

23 Claims, 6 Drawing Sheets

FIG.11
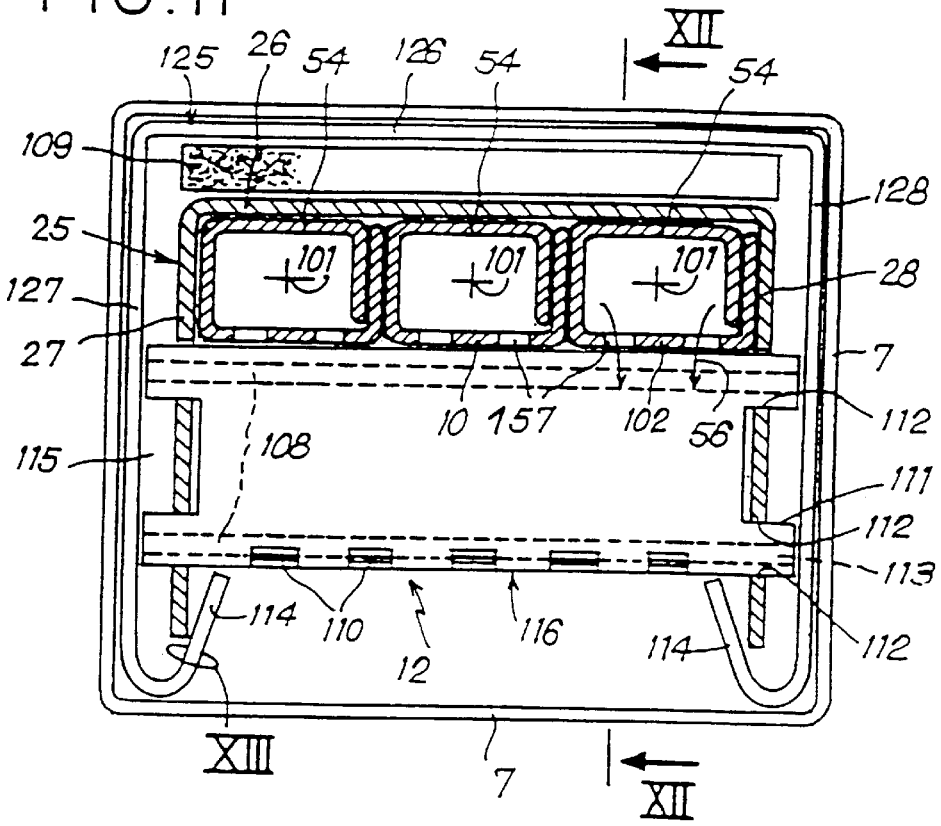
FIG.12
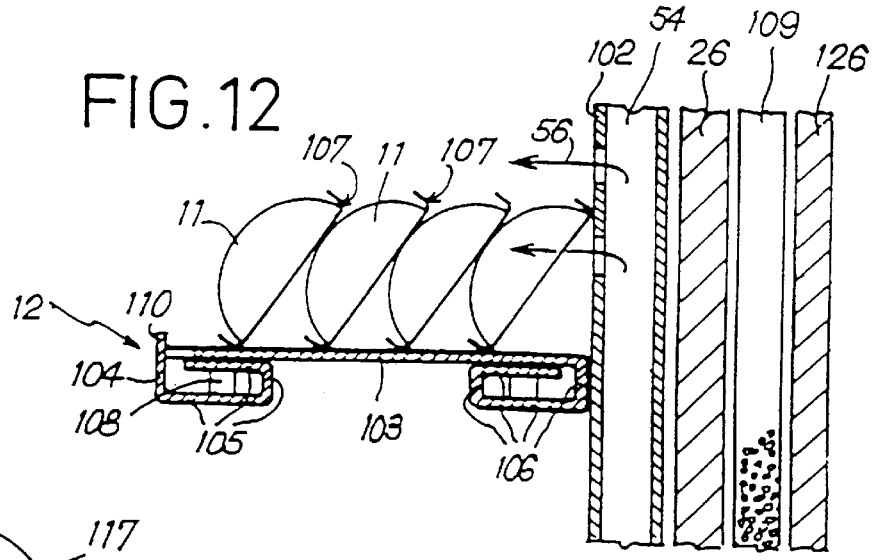
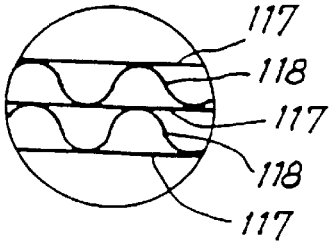
FIG.13

REFRIGERATED CABINET FOR DISPLAYING FOOD OR THE LIKE

The present invention relates to a refrigerated cabinet for displaying and/or conserving perishables, food products or the like, e.g. in a shop.

The technical field of the invention is that of manufacturing refrigerated cabinets.

From international application WO 94/17698 (RENARD) and the corresponding U.S. Pat. No. 5,502,979, which is incorporated herein by reference, a collapsible refrigerated cabinet is known that includes means for circulating and guiding cool air and means for distributing cool air towards display shelves or planes for products and including cover panels made of a material such as card, with the cover forming a portion of a superstructure that is removably mounted on a base which includes means for cooling air and for establishing forcing circulation thereof, i.e. in particular at least a heat exchanger and a fan.

An object of the present invention is to improve the refrigerated cabinets described in the above-mentioned international application.

The solution to the problem posed consists in providing a display module for perishable products that includes at least one air guide duct, and at least one module handling member.

In preferred embodiments of the invention:

said handling member is disposed or fixed in (or is constituted by) Stiffened zone or portion of the module, at the bottom thereof;

said handling member includes or is essentially constituted by a rigid loading support or pallet such as a tray, which includes at least one air guide duct of elongate section, that is preferably rectangular, having a vertical longitudinal axis and suitable for being connected to the duct(s) of the module;

said rigid loading support or pallet is essentially made of card, wood, or plastics materials (or comprises an assembly of elements themselves made of said materials);

said handling member includes or is essentially constituted by one or more and preferably by at least two grip member(s), such as handle(s), strap(s), or loop(s);

said handling member is integrated in or fixed to the base of the module and includes at least two oblong setbacks or projections or openings provided in two substantially vertical side walls of the module that are parallel to each other (e.g. left and right sides);

the walls of said air intake and delivery duct(s) are obtained by folding, i.e. they are built up from one or more folded blanks;

said module includes at least two (e.g. three to six) mutually parallel air delivery ducts, that are preferably juxtaposed (i.e. touching) and substantially identical, and further includes, where appropriate, at least two (e.g. three to six) air intake ducts that are parallel to one another, preferably juxtaposed (i.e. touching), and substantially identical.

By "stiffened" (or "rigid") portion or zone of the display module, the present application means a portion or zone having stiffness and/or bending strength, crushing (or compression) strength, and traction strength considerably greater than the stiffness of the (generally vertical) side panels of the display module, e.g. being at least 50% stronger.

This increased stiffness of the rigid zone can be obtained, for example, by increasing the thickness of the panels of the module in said zone by at least 50%; this stiffened portion may also be obtained by adding a thin piece of a material that is stiffer than that constituting the panels of the display module, placed adjacent to the bottom portions of said panels to constitute and/or surround said handling member; when said handling means is essentially constituted by a grip member such as a handle which is particularly adapted to modules for displaying products of small dimensions or for containing products of low density, said grip members (such as handles) may, for example, be constituted by one or more oblong openings provided in the bottom portions of the left and right side panels of the display module, with the thickness thereof in said zone being reinforced, e.g. being doubled.

When using a pallet or a tray constituting the handling means for the display module, said means is preferably made of a material which is different from the material constituting the panels of the display module; said material constituting the pallet is preferably stiffer than the material constituting the panels of the display module, which pallet (or tray) is adapted for manual or mechanical handling, e.g. by means of a tool such as a forklift truck, in which case said stiffened portion or zone is integrated at least in part in said pallet which is itself preferably integrated in the bottom portion of said display module; this embodiment is particularly adapted to the case where the display module filled with said products has a mass that exceeds 20 kilograms, e.g. in the range 50 to 300 kilograms.

In a particular embodiment, use is made of a pallet (i.e. a loading support or tray that is of flat or flattened shape, rigid, and suitable for handling by means of a forklift truck) that is preferably suitable for being placed or mounted in easily-removable manner on the air cooler unit, and is suitable for supporting (at least one) product display unit, which pallet includes air transport or guide means, and forms the base of the display module which is preferably essentially constituted by elements made of corrugated card or of plastics material such as polypropylene.

The invention also provides a refrigerated cabinet incorporating such product display modules.

In a particular embodiment, a refrigerated cabinet of the invention for displaying products comprises:

a bottom unit or module for cooling air (including at least one inlet orifice for air to be cooled, at least one outlet orifice for cooled air, and at least one air cooling heat exchanger and a fan);

a top unit or module or superstructure for displaying said products which is placed or mounted in easily removable manner on said bottom module, which display module includes an opening of large dimensions defining a zone or face for access to the products displayed therein, and includes air guide means, and, where appropriate, a moving panel (e.g. a removable panel) suitable for closing said opening; and a pallet interposed between said bottom air cooler module and said top product display module, which pallet is provided with (cool) air guide means.

In other preferred features of the invention:

the air guide means of the pallet includes at least one substantially vertical axis duct of small height or length and of flattened or elongate section;

the product display module is essentially constituted by elements or panels made of corrugated card, or of multilayer fiber material, or of plastics material;

the section of said air flow duct provided in the pallet is substantially rectangular, with the ratio of the long dimension to the small dimension of the section of the duct (i.e. the ratio of section length to section width) preferably being not less than 2, e.g. close to the range 5 to 20; by way of example, a blow duct may be constituted by three identical juxtaposed tubular pipes; the section of each pipe may have a width of 20 mm and a length of 160 mm; in another example, the duct comprises a single pipe having a section that is 80 mm wide and 1300 mm long;

the pallet is essentially constituted by wooden strips or battens that are assembled together, e.g. by means of nails or staples;

the pallet includes two mutually parallel elongate side elements such as battens of substantially rectangular section provided with chamfers in their bottom outside portions facilitating centering of the display module while the pallet is moving towards an air cooler module, with the chamfer co-operating with walls or rims disposed at the periphery of the top face of the air cooler module;

the air guide means of the display module include at least one duct (and preferably at least two ducts, e.g. at least three or four ducts) for distributing cool air towards the products on display and for feeding a curtain of air for protecting the facade (or access zone) of the display module, which ducts are of flattened or elongate section, preferably of rectangular section, said ducts being connected via their bases to the air guide means provided in said pallet, said ducts being mutually parallel and placed side by side and/or being stacked on one another;

said air transport chimneys or ducts integrated in the display module are made of corrugated card or of plastics material;

the display module includes one or more first cool air blow ducts (or first air guide means) which extend substantially vertically in the vicinity of a module wall such as a back wall of the module, and includes second air guide means (or second ducts serving as a duct for picking up air coming in particular from the air curtain) extending substantially vertically in the vicinity of a second module wall, which second wall is parallel to said first wall, said second ducts or second air guide means are parallel to said first air guide means, which first and second ducts have their bases connected or placed in substantially airtight contact with respective air takeup and blow openings provided in said pallet and/or in said cooler module;

the preferably vertical side walls of the display module include at least three layers of corrugated card, e.g. at least four layers of corrugated card, e.g. two sheets of corrugated card each including two layers of corrugations;

the walls of the module defining the refrigerated enclosure are thin, preferably being of thickness equal to or smaller than 20 mm or 30 mm, e.g. in the vicinity of 5 mm to 15 mm;

the thin walls are made up of one or more polypropylene section members or blanks;

the module includes corrugated card shelves reinforced by one or more horizontal transverse reinforcements and fitted on their front edges with means for retaining the products displayed on the shelves;

the refrigerated module further includes a skirt-forming element that is preferably made of card or of plastics material, that is suitable for sliding around said air cooler module and around said pallet and said product display module, and in which there is provided at least one (and preferably several) opening allowing air to pass and/or providing access to hatches for inspecting the cooler unit, with the top portion of the front flank forming a portion of the air guide means and situated in the vicinity of the air takeup orifice at the bottom portion of the air curtain;

the air cooler unit includes a top face and side walls, at least two of which (and preferably at least three of which) extend above the top face of the unit; one of the walls (the back wall) preferably extending higher than the top end or top edge of the other two side walls (the left and right walls);

the cooler unit includes legs enabling the unit to stand on the ground, which legs are suitable for cooperating with the top portion of a second air cooler unit identical to said air cooler unit so as to enable a plurality of identical air cooler units to be stacked.

By means of the particular characteristics of the invention relating in particular to the improvements provided to the means for circulating (guiding or channeling) the air cooled by the air cooler unit, firstly with respect to the guide means integrated in the pallet and secondly with respect to the guide means integrated in the superstructure or the product display module, the invention makes it possible to improve air circulation and to improve the effectiveness with which the air cooler module cools, thereby improving conservation conditions for the products; these particular characteristics make it possible in particular and in surprising manner to maintain temperatures inside cabinets (i.e. units for displaying products) whose superstructures may be constituted essentially by panels of corrugated card or of plastics material (where appropriate associated in part with panels of thermal insulation material such as expanded polystyrene, for example), which temperatures are compatible with proper conservation of the products, and in particular are temperatures of less than 0° C. (depending on the performance required).

The invention also makes it possible to facilitate moving the display module, and particularly loading and unloading the display superstructure on the air cooler unit, by making it possible in particular to use handling equipment such as a forklift truck; the superstructure (or product display unit) and the pallet (or handling support tray) which is fitted to said superstructure and to the air cooler unit and which can be integrated in said superstructure can be made in such a manner as to be used on one occasion only (single use) e.g. by being essentially made of card and possibly of polystyrene in the superstructure and of wood and/or card and/or polystyrene in the pallet; these elements also being capable of being made out of plastics material which is preferably recyclable, such as polypropylene, so that they can be used, where appropriate, several times over.

The invention provides a product display superstructure which can be used as packaging for transporting products between a center for packaging products within a display unit and the shop (or the cabinet utilization or product sales area) in which the product display unit is preferably located on the air cooler unit.

The invention thus provides a product display unit (suitable for fitting to an air cooler unit in order to constitute a refrigerated cabinet) which can either be recyclable or for one use only, and in any event is of very low cost, having very high refrigeration performance, and satisfactory strength and stiffness.

The invention facilitates packaging displayed products, facilitates transport thereof, storage thereof in a cold room, and installation thereof in a shop or other sales area.

The invention applies to refrigerated cabinets (and to product display units that are constructed like refrigerated cabinets) that enable the products they contain to be maintained at a low temperature by a flow of cold air that is driven, i.e. propelled, by fans, e.g. to cabinets including a self-contained air cooler unit (i.e. containing a refrigerator unit that compresses a refrigerant, as described in the above-mentioned international application) and which can be connected to an electricity supply on the display site.

Cabinets and superstructures of the invention can be used for conserving a variety of food products, at temperatures that are positive or less than 0° C. in certain cases (e.g. in the range −15 to −20 degrees centigrade).

In a particular use, the refrigerated cabinets and superstructures of the invention can be assembled on the site of use, e.g. for use integrated in display stands at shows or fairs, or they can be used as closed cabinets for conserving food products or the like on a temporary basis, i.e. for several days or even weeks.

The numerous advantages provided by the invention will be better understood from the following description which refers to the accompanying drawings that show preferred embodiments of refrigerated cabinets of the invention and of product display superstructures constituting a part of such cabinets, without the invention being limited thereto in any way.

Figure 6:
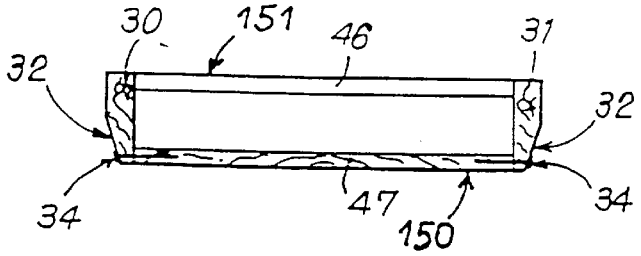
Figure 7:
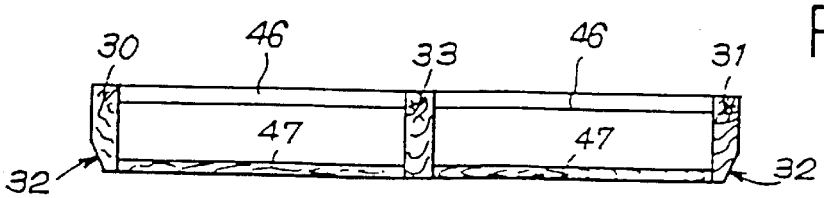

FIGS. 6 and 7 show two preferred variant embodiments of a pallet used for making cabinets of the invention; FIG. 6 is a section view on a vertical plane VI—VI of FIG. 4; FIG. 7 is a view of a variant embodiment likewise in cross-section on a vertical plane.

Figure 8:
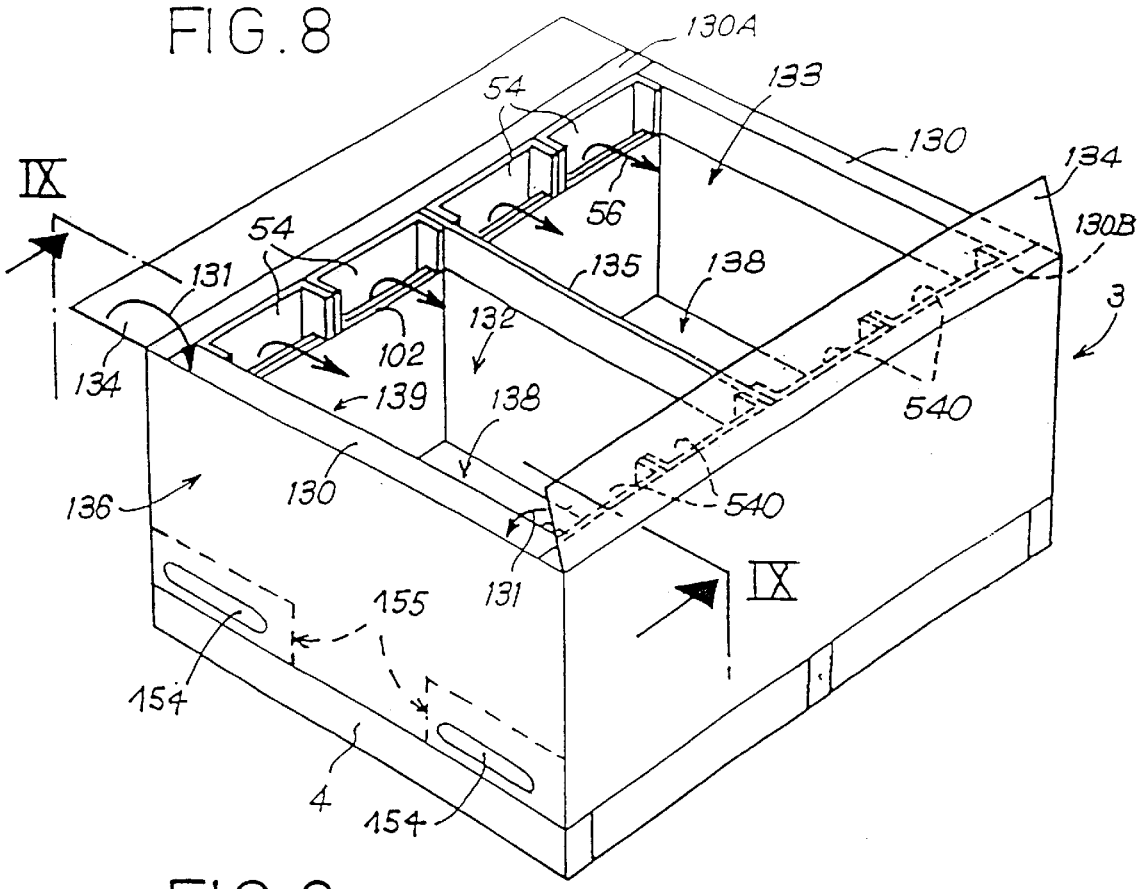

FIG. 8 is a simplified perspective view of an embodiment of a refrigerated cabinet of the invention having a substantially horizontal air curtain and suitable for use in particular for conserving products at temperatures below 0° C.

Figure 9:
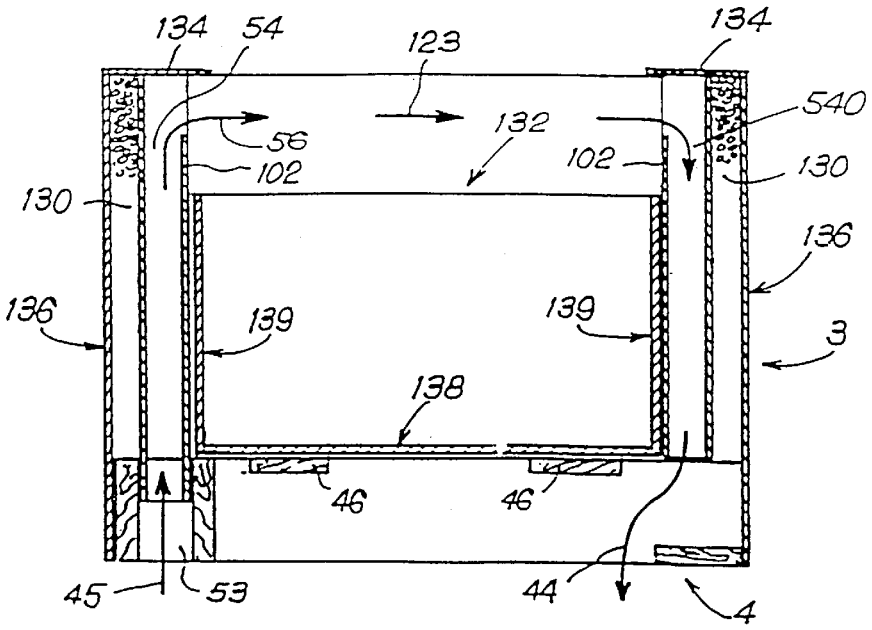

FIG. 9 is a diagrammatic vertical section view showing air circulation in a cabinet as shown in FIG. 8, and is a view on IX—IX of FIG. 8.

Figure 10:
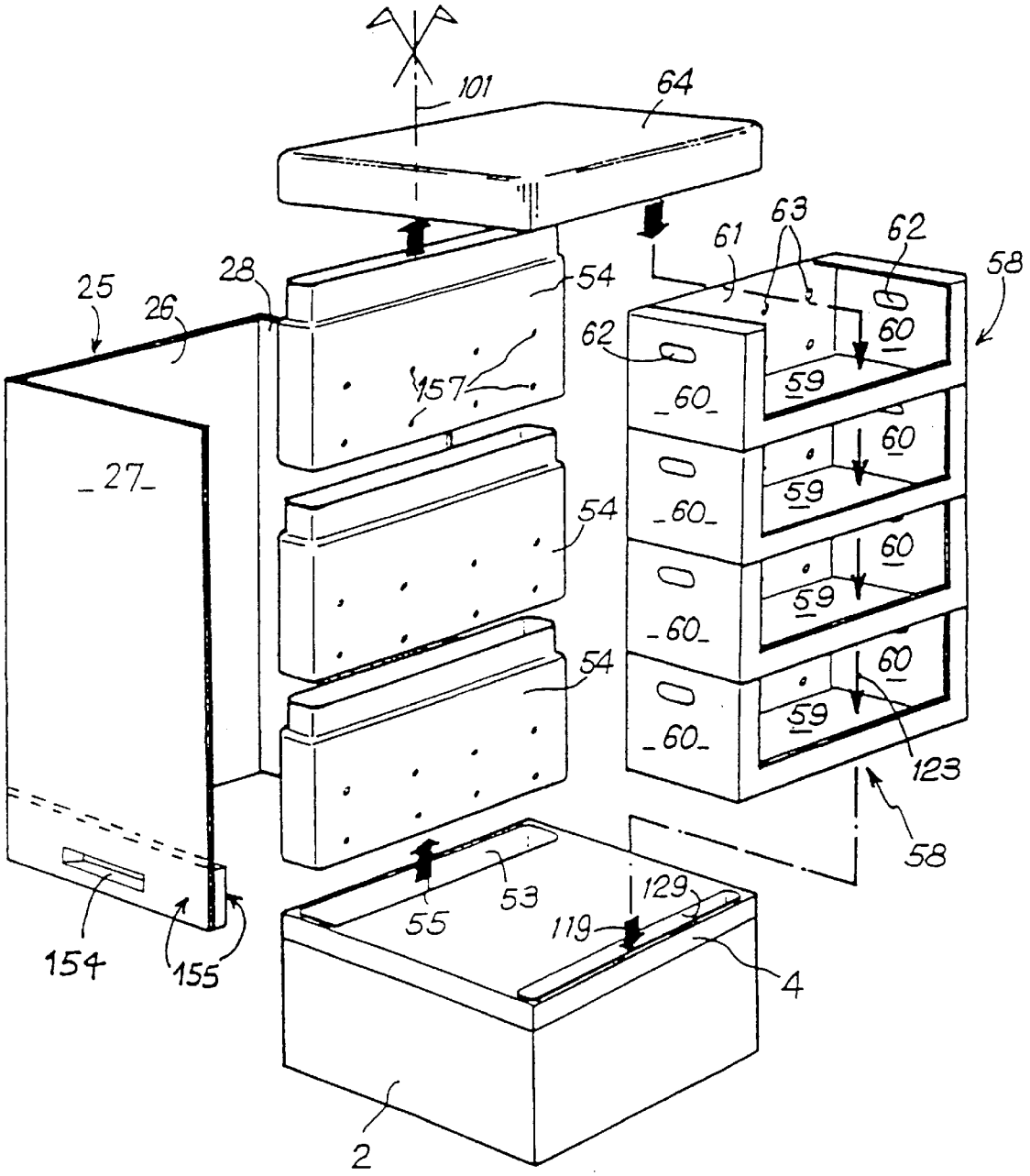

FIG. 10 is an exploded perspective view of a variant embodiment of a refrigerated product display cabinet of the invention (having a downward vertical air curtain) in which the pallet is essentially constituted by a thin rectangular plate pierced by two openings.

FIG. 11 is a section view on a horizontal plane through a product display module fitted with shelves.

FIG. 12 is a section view on XII—XII of FIG. 11 and is a diagram showing a preferred embodiment of shelves and the structure of panels in a product display module of the invention.

FIG. 13 shows a detail of a card panel used in making a product display module of the invention (with reference to FIG. 11).

Unless explicitly stated otherwise, the terms "front", "back", "top", "bottom", "left", "right", "vertical", and "horizontal" are used with reference to an observer looking at the cabinet and/or the display unit with the access opening thereof facing the observer, and/or with the observer taking up the position of a user of the cabinet and/or of a purchaser of the products on display.

Unless stated otherwise, when the same reference is used more than once in one or more figures, then it designates elements that are identical or similar.

Figure 1:
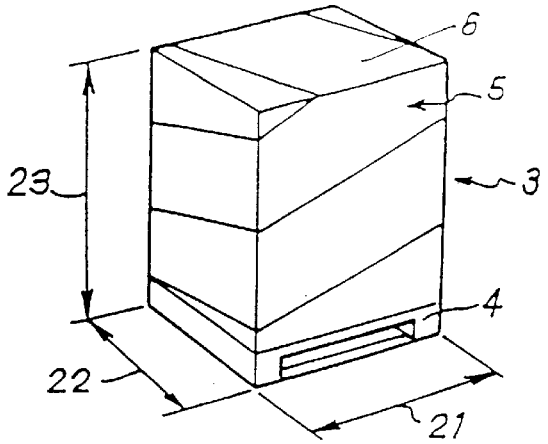
FIG. 1 is a diagrammatic perspective view of a refrigerated cabinet superstructure of the invention used as transport packaging for the products it contains.
Figure 2:
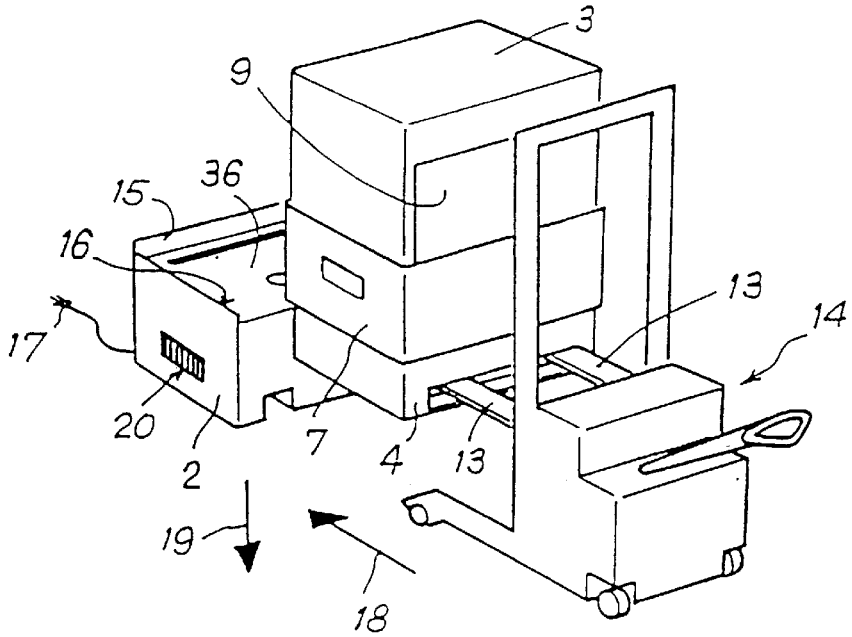
FIG. 2 is a diagrammatic perspective view showing how the product display structure is put into place on an air cooler module baa a forklift truck.
Figure 3:
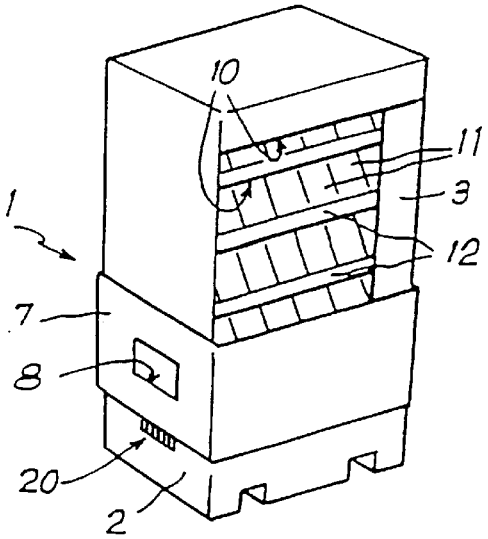
FIG. 3 is a simplified perspective view showing a final operation of placing a product display superstructure on an air cooler module.

With reference to FIGS. 1 to 3, a refrigerated cabinet 1 of the invention has a base 2 constituting an air cooler module and capable of receiving on its substantially horizontal top wall or face 36 a module 3 for displaying food products, e.g. packaged in individual packages in the form of small trays, referenced 11 and shown more clearly in FIGS. 3 and 12.

As shown in FIGS. 1 and 2, the bottom portion of the product display module of superstructure 3 includes a pallet 4 and together they fit within a rectangular parallelepiped of width 21, depth 22, and height 23 having dimensions close to 800 mm, 600 mm, and 1200 mm respectively in one particular embodiment.

As shown in FIG. 1, the display module 3 may constitute a module 5 for transporting and temporarily storing the products it contains, which storage may be performed either in a cold room or in refrigerated premises, or else in premises that are not refrigerated, in which case the module 3 is placed on a cooler module 2 so as to conserve the food products contained in the module 3, 5 while they are being stored.

As shown particularly in FIG. 2, the base of the display module 3 is: essentially constituted by a pallet 4 suitable for receiving at least a portion of the tines 13 of a forklift truck 14 enabling the product display module 3 to be handled while it contains products that have previously been loaded therein, to enable said display module to be placed on the top face 36 of a chest surrounding the air cooler unit 2 by moving the module in translation 18 substantially parallel to the side edges 16 of the chest and then moving it vertically downwards along arrow 19, during which movement chamfers (referenced 32 in FIGS. 4, 6, and 7) provided on the bottom side edges of the pallet 4 facilitate centering and relative positioning of the module 3 on the module 2.

As shown in FIGS. 2 and 3 in particular, the display module 3 may be delivered with a panel 7, e.g. made of card, constituting a skirt or band surrounding the module 3 and capable of sliding around the module 3 along a longitudinal vertical axis of the module 3 once the module 3 has been put into position on the air cooler module 2, the skirt moving down to cover the side walls of the air cooler module 2 so that openings 8 precut or provided in the facets of the sliding panel 7 come into register with windows 20 (such as ventilation grilles or access hatches) provided in the side walls of the air cooler unit.

For transport or storage, particularly of the product display module 3, a removable panel 9, e.g. a front vertical panel, is provided for closing the opening 10 that forms an access zone to the products 11 placed on a plurality of shelves 12 superposed inside the product display unit 3; the panel 9 can be removed when the cabinet is put into place in a sale area.

Figure 4:
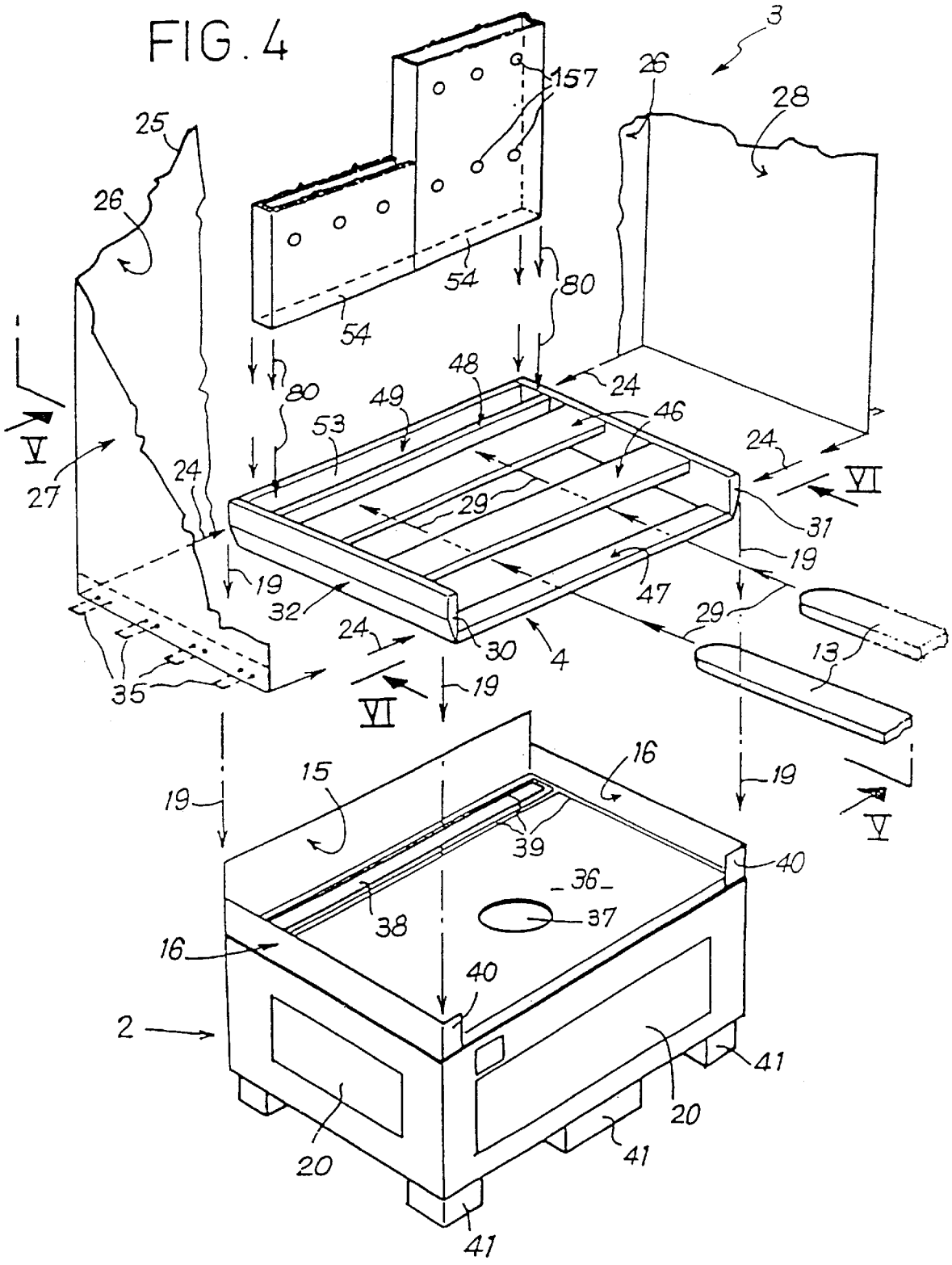
FIG. 4 is a simplified exploded view in perspective showing the bottom portion of the product display module and an air cooler module, for explaining how the various components of the product display module are assembled together.
Figure 5:
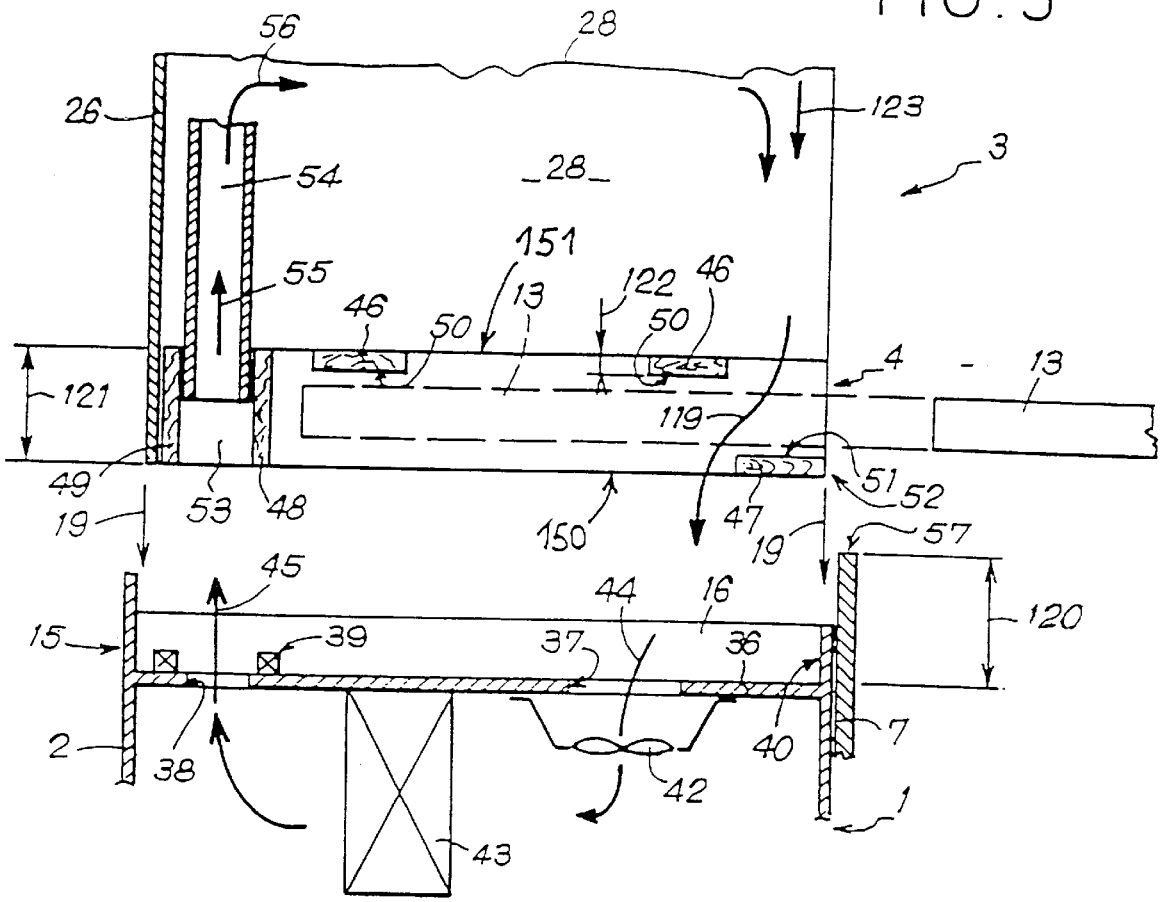
FIG. 5 is a simplified view in partial section on a vertical plane V—V of FIG. 4, showing diagrammatically how a product display module pallet is fitted on an air cooler module, and showing the elements for assembling them together.

With reference to FIGS. 2, 4, and 5, the relative positioning and engagement of the product display unit 3 on the air cooler unit 2 is performed by downward movement indicated by arrows 19 until the base of the display module 3 as essentially constituted by the pallet 4 comes to rest on the substantially horizontal top wall 36 of the air cooler module 2; said wall 36 is pierced by at least one orifice 37 allowing air to enter into the module 2, as represented in FIG. 5 by arrow 44, and also by at least one blow opening 38 allowing air cooled by the module 2 to leave along arrow 45, as shown in FIG. 5.

Beneath its top wall 36, the cooler module includes at least one fan 42 for propelling air and causing it to pass in contact with a heat exchanger 43 that cools the air before it is blown towards the inside volume of the product display module 3 by the means described below.

As shown in FIGS. 4 and 5 in particular, air sealing means 39 are provided, particularly along the entire periphery of the opening 38 of elongate shape, as shown in FIG. 4, that is preferably rectangular and of length that is large compared with its width.

With reference to FIGS. 4 and 5 in particular, the pallet 4 constituting the base of the display module 3 enables the tines 13 of a forklift truck to be inserted inside the volume defined by the pallet, which tines are shown in FIGS. 4 and 5 in a position outside the pallet (in continuous lines) and are shown substantially in the pallet-transporting position in FIG. 5 (in dashed lines) with the tines 13 penetrating into the empty volume of the pallet 4 along arrows 29 of FIG. 4.

As shown in FIGS. 4 to 7 in particular, the pallet 4 may include two parallel horizontal battens 30 and 31 disposed at the right and left sides of the pallet, an additional horizontal batten 33 (FIG. 7) optionally also being provided; the bottoms of the vertical panels 27 and 28 (left and right) of the module 3 being suitable for fixing by staples 35 to the flanks of the battens 30, 31.

The battens 30, 31, and 33 are connected to one another by planks 46 to 49 extending horizontally and perpendicularly to said battens, and the ends of the planks are assembled to the battens by means of nails 34 (FIG. 6) or by any other means, in particular by staples.

As shown more particularly in FIG. 5, the planks 46 occupying the top of the pallet 4 are substantially flush with the top edges of the side battens 30 and 31, enabling the product display module 3 to be transported by a forklift truck having tines 13 so that the bottom faces 50 of the planks 46 rest on said tines, with the positions (along the battens 30 and 31) of the planks 46 being such that the center of gravity of the module 3 is situated between the planks.

Also, the top face 51 of the bottom plank 47 which is situated in the immediate vicinity of the front edge 52 of the pallet 4 serves to avoid any tilting movement of the module 3 placed on the pallet by coming into contact with the bottom faces of the tines 13 should any such tilting begin to happen.

The front face of a front vertically disposed plank 48 (i.e. a plank on edge) forms an abutment against which the leading ends of the tines 13 come into abutment when they are being inserted in the direction of arrows 29 (FIG. 4).

The substantially vertical parallel walls or planks 48 and 49 (i.e. planks that are on edge) provided at the back portion of the pallet 4 serve essentially to define a duct 53 in which one or more ducts 54 forming a portion of the product display module 3 are engaged (by a downward vertical movement as referenced 80 in FIG. 4); the duct 53 serves for positioning the ducts 54 substantially vertically and also serves to provide continuity of guidance for the air expelled from the cooler module 2 along arrow 45 so that the cool air leaving the opening 38 is guided and channeled in substantially airtight manner to the ducts 54 integrated in the product display module 3; the cool air is thus channeled by the ducts 54 along arrow 55 and is then distributed along arrows 56 to the various product display planes or shelves, and also to the guide duct for the air curtain 123.

As shown in FIG. 5 in particular, the air is then sucked (arrow 119) into the bottom portion of the display module via the space or opening defined by the front edge of the first plank 46 and the top edge 57 of the skirt which surrounds the unit 2; said edge 57 extends above the top face 151 of the pallet 4 when it is placed via its base 150 on the top panel 36 of the module 2 (after moving down along arrows 19), because the height 120 measured between the substantially horizontal top edge 57 of the front flank of the skirt 7 surrounding the refrigerator unit 2 and the top wall 36 of the cooler module 2 (against which the pallet rests) is greater than the height (or thickness) 121 of the pallet 4; the height of the duct 53 defined by the vertical walls or planks 48 and 49 of the pallet 4, which is of the order of about 10 cm, for example, is equal in this embodiment to the thickness 121 of the pallet.

In this way, the air curtain or flow 123 moving vertically downwards (in this embodiment) can be taken up (sucked in) at least in part via the takeup orifice left free between the edge 57 of the front wall of the skirt 7 and the front edge of the plank 46 of the pallet 4, so as to circulate along arrows 119 and 44 to the takeup opening 37 provided in the module 2.

With reference to FIGS. 4, 5, and 10, the module 3 is defined by vertical side walls 26, 27, and 28 whose bases may be fixed by staples 35 to the battens 30 and 31 (by a vertical assembly movement as represented by arrows 24), thus constituting an envelope 25 having three vertical panels which can be obtained by folding a corrugated card blank into a U-shape.

FIG. 10 shows a variant embodiment of the invention adaptable to using plastics material for making the main components of the display module of the refrigerated cabinet of the invention.

As shown in this figure, the cabinet whose main components are shown diagrammatically (in an exploded view) comprises an air cooler module or unit 2 which receives a pallet 4 on its top face that acts as an interface between the module 2 and a product display module 3 and which also acts as a support for the module 3.

The pallet 4 has an opening 129 in its front portion for sucking in (or taking up) along arrow 119 the flow of air coming in particular from the air curtain circulating alongarrows 123 in front of the front portions of the trays 58 that receive the products displayed in the module.

The air taken up in this way and then blown out by the module 2 (after being cooled) along arrow 55 passes through the rear portion of the pallet 4 via an air guide duct 53 with which it is fitted so as to penetrate into a stack of three air guide duct lengths 54 forming a portion of the product display module; each of said duct lengths 54 is constituted by a vertical axis tube portion of substantially rectangular section that is not constant, the section of the top portion of each duct length being made smaller so as to enable the lengths 54 to be engaged mutually and interconnected in substantially airtight manner when they are stacked on one another along their common vertically-extending longitudinal axis 101.

The products to be displayed are contained in four self-supporting trays 58 which are superposed, with the bottom tray in the stack resting on the pallet 4; each of said trays is provided with a vertical back wall 61 provided with perforations 63 and pressed substantially flat against the front face of a duct length 54 so that the perforations 63 in the trays are substantially in register with perforations 157 provided in the front faces of the duct lengths 54, thus enabling a fraction of the air flowing along the duct lengths 54 to pass through (be distributed) towards each tray so as to maintain the products contained by the trays 58 at a desired temperature.

Each tray 58 has a horizontal back wall 59, two side walls 60 each provided with an oblong opening 62 enabling each of the trays 58 to be handled individually by hand, with the trays 59 and 60 being provided with an edge folded through 90° and thus co-operating with the back wall 61 to form a semirigid assembly that can be made of corrugated card or of plastics material.

The ducts 54 and the trays 58 are covered by a roof panel 64 that serves to guide the air leaving the ducts 54 so as to form an air curtain 123 that is substantially vertical and downwardly directed; the assembly made up of the lengths 54 and the trays 58 is substantially surrounded by a U-shaped panel 25 having a vertical back wall and two thin vertical walls, one on the left 27 and another on the right 28.

A variant embodiment of the display module having a substantially vertical air curtain is shown in FIGS. 11 to 13, in which the channels for guiding and distributing air in the product display unit are constituted by three identical lengths of tube 54 that are disposed side by side and mutually parallel (having a vertical longitudinal axis 101) and which can be made of folded corrugated card.

As in FIGS. 4 and 10, the channels 54 are provided in their front walls or portions 102 with perforations 157 allowing a fraction of the flow of cool air that is guided and distributed by the channels 54 to pass through into each of the shelves or each product display zone, along arrows 56; the ducts 54 are of substantially constant rectangular section and have their bottom ends in communication with (are connected via) the duct 53 for guiding cool air that is provided in the pallet.

Said left side wall 27, said back wall 26, and said right side wall 28 which are vertical and obtained by folding a panel 25 of corrugated card into a U-shape, are constituted, as shown in FIG. 13, in the same manner as a panel 125 folded into a U-shape, by two vertical fluted or corrugated sheets 118 which are interposed and stuck against three substantially plane sheets 117.

In each of the left and right sides or flanks 27 and 28 of the panel 25, there are provided openings 112 allowing projecting ends 111 of the shelves 12 and ends 113 of transverse reinforcements 108 for said shelves 12 to pass therethrough and through the panel 27, 28, as also shown in FIG. 12.

As shown in FIG. 11, each of the shelves 12 is provided in the vicinity of its front edge 116 with projections 110 forming abutments that are designed to prevent products placed on the shelf from sliding and falling; these abutments may be obtained by cutting out a portion of the main panel 103 of the shelf, which may be made essentially out of corrugated card; with reference to FIG. 12, shelf panel 103 is extended along its front edge by a front rim 104 obtained by folding the same card flank as the flank used for making the panel 103, together with three other successive folds 105 which surround a transverse reinforcing member 108 that extends substantially along the entire width of the shelf 12 and increases its stiffness; the products 11 are shown diagrammatically as being packaged in small trays 107 which are in a sloping position with the last one pressing against the front walls 102 of the air distribution channels 54.

In the same manner, the back edge of the shelf 12 is constituted by four successive folds 106 in the flank of the card used for making the shelf, which folds 106 provide a rectangular channel in which a second reinforcing member 108 is housed, which member is preferably made of wood and likewise extends through the openings 112 provided in the side walls 27 and 28 of the panel 25.

As shown in FIG. 11, the assembly is surrounded by a second thin panel 125 that is folded into a U-shape, having a left vertical side 127, a vertical back panel 126, and a right vertical side 128, which sides 127 and 128 are extended at their front edges (or on their front or forward ends) by two folds 114 serving to lock the shelves 112 in position.

As shown in FIG. 11, an additional panel 109 of expanded polystyrene and having a thickness of about 1 cm to 2 cm can be received between the U-shaped panels 25 and 125, specifically to improve thermal insulation of the back wall 26, 126 of the display unit; depending on the desired temperatures that are to be maintained inside such a unit, such panels can be found to be necessary, particularly when the temperature inside the cabinet is to remain below 0° C. while ambient temperature is 30° C.; in many cases, making a display unit from panels of corrugated card (with one or two layers of corrugation as shown in FIG. 13), and with the presence of sheets of air 115 extending between the panels 25 and 125, it is possible to provide satisfactory thermal insulation.

As shown in FIG. 11, the assembly is surrounded at its base by a skirt 7 surrounding the panels 25 and 125, and also surrounding the cooler module that supports the display module.

FIGS. 8 and 9 are respectively a simplified perspective view and a simplified vertical section view showing an application of the invention to a product display structure that is provided with a horizontal air curtain, as shown in these figures by arrows 123, which air curtain extends over the top of the module 3 and of the corresponding refrigerated cabinet, over the access opening which it protects from heat input.

FIGS. 8 and 9 show a display module 3 that is generally in the form of a rectangular parallelepiped, standing on a pallet 4 of the invention, with the air cooler module not being shown in these figures.

As already mentioned with reference to FIG. 5, air coming from the air takeup ducts 540 is sucked in by the fan of the air cooler module along arrows 44; after being cooled, the air is blown out along arrow 45 into the duct 53 provided through the pallet 4, and then into the duct 54 provided in the display unit 3 which extends the duct 53.

In this embodiment of the display module, which can be used in particular for "catering" type products, or for products that are conserved and/or displayed at temperatures of less than 0° C., the ducts 54 are not perforated, but their front wall 102 is interrupted near the top (at a height that is lower than the height of the top end of the duct 54) so as to leave a substantially rectangular opening as shown in FIG. 8, allowing cooled air to be blown along arrow 56 so as to form the air curtain 123.

As shown in these figures, it can be seen that display unit 3 essentially comprises the following elements:

- one (or more, internal envelopes or boxes of corrugated card 132, 133, each constituted by a bottom wall 138 and side walls 139; as shown in FIG. 8, two internal parallelepipal boxes 132 and 133 can be provided which are separated by a plane vertical partition 135;
- four guide ducts 54 provided with a horizontal blow opening for blowing cold air along arrow 56, which ducts are parallel to one another and to one of the vertical walls or partitions of the display unit;

four air takeup ducts 540 for taking up air that comes from the air curtain 123 to guide it to the suction inlet of the air cooler module, which ducts extend vertically parallel to one another and parallel to a second wall of the display unit which is parallel to the first wall along which the first blow ducts 54 extend; and an outer parallelepipal box 136 of corrugated card.

When such a display unit is used for products that need to be conserved at a temperature of less than 0 degrees, insulating panels 130, 130*a*, and 130*b* are preferably provided between the back faces of the ducts 54, 540 and the inside faces of the outer box 136, two of whose vertical parallel walls are provided at their top ends with projecting margins 134 suitable for being folded (along arrows 131) so as to constitute flaps that serve to deflect the air guided by the ducts 54 and the ducts 540 through about 90°, as shown in particular in FIG. 9.

As shown in FIGS. 8 and 9, a horizontal air curtain display module need not have any shelves or trays, and that can also apply to display modules having an inclined and in particular a vertical air curtain, in which case the displayed products are stacked on the pallet or on a bottom that is itself standing on the pallet. Sufficient stiffness is obtained for the display module in particular because of the air guide ducts or tubes provided through the pallet and/or the display superstructure.

In the specific case of a display module that is small in size and in mass, the handling pallet can be associated with or replaced by handles (154, FIGS. 8 and 10) that are integrated in the display module, and that are essentially constituted by reinforcement or openings provided in rigid bottom portions 155 of the side walls thereof (such as 27).

I claim:

1. A refrigerated cabinet including an air cooler module and including a product display module which is easily secured in removable manner to said air cooler module, the product display module including:

an enclosure defined by walls, the enclosure comprising an access opening for access to products, at least one first air guide duct provided with an air blow opening allowing air to be blown so as to form an air curtain protecting said access opening, at least one module handling member disposed in a bottom portion of the product display module, said module handling member comprising at least one second air guide duct suitable for being connected to said first air guide duct, and a suction opening for taking up flow of air coming from the air curtain, and at least two first air blow ducts extending substantially vertically in the vicinity of or along one of said walls and constituted by one or more folded blanks.

2. A module according to claim 1, in which said handling member comprises a rigid loading support or pallet such as a tray including at least one air guide duct of elongate section, which section is preferably substantially rectangular, of vertical longitudinal axis, and suitable for being connected to the duct(s) of the module.

3. A module according to claim 2, in which said pallet is fixed to the bottom portion of said product display module by assembly means such as staples.

4. A module according to claim 1, in which the side walls of the display module include at least three layers of corrugated card, or are essentially constituted by one or more blanks of polypropylene.

5. A module according to claim 1, including shelves of reinforced corrugated card, and where appropriate including an opening defining an access face to products displayed in the display module, and said module includes a moving panel suitable for closing said opening.

6. A refrigerated cabinet according to claim 1, further including a card or plastics material element suitable for sliding along said air cooler module and including at least one opening allowing air to pass and/or providing access to inspection hatches of the cooler module, and in which the air cooler module or unit includes a top wall or face and side walls extending in part at least over said top wall or face, and in which the cooler module or unit includes legs of shape and structure that are adapted to enable a plurality of said air cooler units to be stacked one on another.

7. A refrigerated cabinet including an air cooler module and including a product display module for displaying perishable products, the product display module including at least one air guide duct, and including at least one module handling member, which product display module is easily secured in removable manner to said air cooler module, said refrigerated cabinet further including a card or plastics material element suitable for sliding along said air cooler module and including at least one opening allowing air to pass and/or providing access to inspection hatches of the cooler module, and in which the air cooler module or unit includes a top wall or face and side walls extending in part at least over said top wall or face, and in which the cooler module or unit includes legs of shape and structure that are adapted to enable a plurality of said air cooler units to be stacked one on another.

8. A module according to claim 7, in which said handling member comprises a rigid loading support or pallet such as a tray including at least one air guide duct of elongate section, which section is preferably substantially rectangular, of vertical longitudinal axis, and suitable for being connected to the duct(s) of the module.

9. A module according to claim 8, in which said pallet is fixed to the bottom portion of said product display module by assembly means such as staples.

10. A module according to claim 7, in which the side walls of the display module include at least three layers of corrugated card, or are essentially constituted by one or more blanks of polypropylene.

11. A module according to claim 7, including shelves of reinforced corrugated card, and where appropriate including an opening defining an access face to products displayed module, and said module includes a moving panel suitable for closing said opening.

12. A module for displaying perishable products, the module including:

an enclosure defined by walls, the enclosure comprising an access opening for access to said products, at least one first air guide duct provided with an air blow opening allowing air to be blown so as to form an air curtain protecting said access opening, at least one module handling member disposed in a bottom portion of the module, said module handling member comprising at least one second air guide duct suitable for being connected to said first air guide duct, and a suction opening for taking up flow of air coming from the air curtain, said first air guide duct including at least one first air blow duct extending substantially vertically in the vicinity of or along one of said walls and constituted by one or more folded blanks, and wherein said module handling member is essentially constituted by batters assembled together.

13. A module according to claim 12, in which said handling member comprises a rigid loading support or pallet such as a tray including at least one air guide duct of elongate section, which section is preferably substantially rectangular, of vertical longitudinal axis, and suitable for being connected to the duct(s) of the module.

14. A module according to claim 13, in which said pallet is fixed to the bottom portion of said product display module by assembly means as such staples.

15. A module according to claim 12, in which the side walls of the display module include at least three layers of corrugated card, or are essentially constituted by one or more blanks of polypropylene.

16. A module according to claim 12, including shelves of reinforced corrugated card, and where appropriate including an opening defining an access face to products displayed in the display module, and said module includes a moving panel suitable for closing said opening.

17. A refrigerated cabinet according to claim 12, further including a card or plastics material element suitable for sliding along said air cooler module and including at least one opening allowing air to pass and/or providing access to inspection hatches of the cooler module, and in which the air cooler module or unit includes a top wall or face and side walls extending in part at least over said top wall or face, and in which the cooler module or unit includes legs of shape and structure that are adapted to enable a plurality of said air cooler units to be stacked one on another.

18. A module for displaying perishable products, the module including:

an enclosure defined by walls, the enclosure comprising an access opening for access to said products, at least one first air guide duct provided with an air blow opening allowing air to be blown so as to form an air curtain protecting said access opening, at least one module handling member disposed in a bottom portion of the module, said module handling member comprising at least one second air guide duct suitable for being connected to said first air guide duct, and a suction opening for taking up flow of air coming from the air curtain, said first air guide duct including at least one first air blow duct extending substantially vertically in the vicinity of or along one of said walls and constituted by one or more folded blanks, and wherein said module handling member is essentially made of card or plastics material.

19. A module according to claim 18, in which said handling member comprises a rigid loading support or pallet such as a tray including at least one air guide duct of elongate section, which section is preferably substantially rectangular, of vertical longitudinal axis, and suitable for being connected to the duct(s) of the module.

20. A module according to claim 19, in which said pallet is fixed to the bottom portion of said product display module by assembly means such as staples.

21. A module according to claim 18, in which the side walls of the display module include at least three layers of corrugated card, or are essentially constituted by one or more blanks of polypropylene.

22. A module according to claim 18, including shelves of reinforced corrugated card, and where appropriate including an opening defining an access face to products displayed in the display module, and said module includes a moving panel suitable for closing said opening.

23. A refrigerated cabinet according to claim 18, further including a card or plastics material element suitable for sliding along said air cooler module and including at least one opening allowing air to pass and/or providing access to inspection hatches of the cooler module, and in which the air cooler module or unit includes a top wall or face and side walls extending in part at least over said top wall or face, and in which the cooler module or unit includes legs of shape and structure that are adapted to enable a plurality of said air cooler units to be stacked one on another.

* * * * *